US005974761A

United States Patent [19]

Mochizuki et al.

[11] Patent Number: 5,974,761

[45] Date of Patent: Nov. 2, 1999

[54] MORTAR GROUT SPLICE SLEEVE FOR REINFORCING BARS

[76] Inventors: Hitoshi Mochizuki; Takayuki Nihei, both of Tokyo, Japan

[21] Appl. No.: 08/860,173

[22] PCT Filed: Nov. 8, 1996

[86] PCT No.: PCT/JP96/03282

§ 371 Date: Jun. 16, 1997

§ 102(e) Date: Jun. 16, 1997

[87] PCT Pub. No.: WO97/17511

PCT Pub. Date: May 15, 1997

[30] Foreign Application Priority Data

Nov. 10, 1995 [JP] Japan ..... 7-293035

[51] Int. Cl.[6] ..... E04C 3/30

[52] U.S. Cl. ..... 52/740.1; 403/267; 403/362

[58] Field of Search ..... 52/740.1, 740.7, 52/740.2, 740.3, 740.4, 740.5, 740.6, 740.8, 740.9, 730.1, 742.1, 742.13, 742.16, 724.2, 730.2; 403/267, 260, 265, 362

[56] References Cited

U.S. PATENT DOCUMENTS 4,666,326 5/1987 Hope ..... 403/265

FOREIGN PATENT DOCUMENTS 54-75126 6/1979 Japan .
434318 U 3/1992 Japan .
5321407 12/1993 Japan .

*Primary Examiner*—Creighton Smith

[57] ABSTRACT

A sleeve for splicing together reinforcing bars disposed in an opposing, end-to-end relationship comprising a tubular shell member provided with opposing end walls, a grout port provided in the tubular shell for adding grout to the interior of the tubular shell, apertures provided in the end walls for receiving the reinforcing bars from opposite ends thereof, a plurality of supporting projections integrally formed with the tubular shell and extending from one side of the tubular shell, fixing means adapted to be inserted into the tubular shell on longitudinally opposite sides from the supporting projections and intermediate the supporting projections for fastening the reinforcing bar to the supporting projections, the supporting projections being formed, in cross section, with a recess for receiving the reinforcing bar coaxial to the tubular shell.

10 Claims, 5 Drawing Sheets

MORTAR GROUT SPLICE SLEEVE FOR REINFORCING BARS

FIELD OF THE INVENTION

The present invention relates to a mortar grout splice sleeve for reinforcing bars utilized in reinforced concrete construction methods, and in particular to a splice sleeve available for an end-to-end connection of opposite reinforcing bars used in a cast-in-place concrete construction method as well as in a precast concrete construction method.

BACKGROUND OF THE INVENTION

In the cast-in-place concrete construction method, reinforcing bars are assembled to a building framework in the field of construction, in which a reinforcing bar often has an end thereof connected to an end of the other reinforcing bar. In the precast concrete construction method, precast concrete members are assembled to a concrete building in the field of construction, in which, in most, one precast concrete member has at least one splice sleeve therein connected with an end of the respective reinforcing bar projected from the other member. Sometimes, it is needed that the both precast concrete members have the opposite ends of their respective reinforcing bars connected with each other and that the reinforcing bars are fixedly supported immediately after being abutted in the both construction methods. This needs such a mortar grout splice sleeve that is able to fixedly hold the reinforcing bar prior to mortar hardening.

The prior art sleeve has an inner diameter much larger than the outer diameter of the reinforcing bar because of being required to receive the reinforcing bar with a large tolerance. Therefore, the sleeve is unable to hold the reinforcing bar fixedly therein without mortar hardening. Conventionally, the following methods have been adopted for connecting the both ends of the opposite reinforcing bars and fixedly holding them at once after being connected. A pressure welding method connects thee both reinforcing bars by heating their abutted end faces with pressure. A butt welding method connects the both reinforcing bars by welding their abutted end portions. A lap joint method connects the both reinforcing bars by tying their overlapped end portions with steel wires. A screw-coupling method connects the both reinforcing bars by screwing their external threaded end portions into the internal threads of a coupling sleeve. However, both the pressure and butt welding methods require apparatus for heating the end portion of the reinforcing bar and worker's skillness. At any rate, it is difficult to realize a reliable welding work in the field of construction. Besides, the butt welding method requires a laborious preparation of the end face of the reinforcing bar prior to welding. The lap joint method requires the overlapped end portions of the bars to have an axial length by at least 20 times longer than the diameter of the bar. It is not suitable to diametrally large iron bars, because the overlapped portions of the diametrally large iron bars reduce an amount of concrete to an undesired one. The screw-coupling method disadvantageously requires an operation to thread the end portion of the reinforcing bar and rotate either of the reinforcing bar and the coupler. In addition, in case of the end-to-end connection of reinforcing bars of the precast concrete members, there is another problem that secondary stress produced by welding heat may give an undesirable influence to a positional relationship between the precast concrete members to be connected to each other. The present invention is intended to solve the problems as described above. It provides a mortar grout splice sleeve utilizable both in the cast-in-place and precast concrete construction methods. The sleeve receives the reinforcing bar fixedly prior to mortar hardening. The sleeve also makes an easy and reliable end-to-end connection between the both reinforcing bars without requiring any of a special device for heating, a laborious preparation, and skilled workers. The use of the inventive sleeve results in that the diametrally large reinforcing bars are connected to each other without reducing a desired amount of concrete, and that the precast members are free from an inconvenient secondary stress when connected to each other.

SUMMARY OF THE INVENTION

A mortar grout splice sleeve for reinforcing bars according to the invention comprises a tubular metal shell of the type having openings provided in both end portions through which reinforcing bars are inserted, and a grout port in the tubular portion through which mortar is injected into the shell. The shell is provided in the internal circumference thereof with at least a pair of outward and inward supporting projections for supporting the reinforcing bar. The shell is also provided in each tubular portion between the paired outward and inward supporting projections with a hole through which fixing means fastens the reinforcing bar to the supporting projections. In general, the supporting projections are arranged to receive the reinforcing bar coaxial to the shell.

In the case of the shell supporting one of the both reinforcing bars, the shell is provided with a set of fixing means and a pair of the outward and inward supporting projection.

In preference, the outward supporting projection is formed integrally with the end portion of the shell. The supporting projection has a cross-section formed with a recess for receiving the reinforcing bar. The cross-section is selectively shaped in the form of a hollow circle, a sector, a rectangle, or a trapezoid. The cross-section can have at least a radial slit. The recess is selectively curved or V-shaped.

In preference, the outward and inward supporting projections are joined with each other to form an oblong supporting projection having an axially continuous supporting face longer than a distance between both adjacent ridges of the reinforcing bar, so that the reinforcing bar is always supported at its ridges by the supporting face.

In preference, the fixing means is selected from a bolt and a pin. The bolt is screwed into the hole from outside to fasten the reinforcing bar to the supporting projections. Either of a taper pin and a coil-type spring pin is forced in the hole from outside to fasten the reinforcing bar to the supporting projections. The hole is selectively formed to direct the pin perpendicular or tangential to the reinforcing bar.

The advantages offered by the invention are mainly that the mortar grout splice sleeve is available for an end-to-end connection of the both reinforcing bars used both in the cast-in-place concrete construction method and in the precast concrete construction method because of holding the reinforcing bars fixedly prior to mortar hardening. The use of the sleeve requires no a heating device, nor a laborious preparation for opposite ends of the reinforcing bars, nor an incovenient operation for rotating either of the reinforcing bar and the coupler. The sleeve allows an endwise connection of reinforcing bars of relatively large diameter without overlapping them. All in all, the mortar grout splice sleeve makes a highly reliable endwise connection of the both reinforcing bars with ease.

DETAILED DESCRIPTION OF THE INVENTION

The invention is described in detail below with reference to the drawings which illustrate preferred embodiments.

Figure 1:
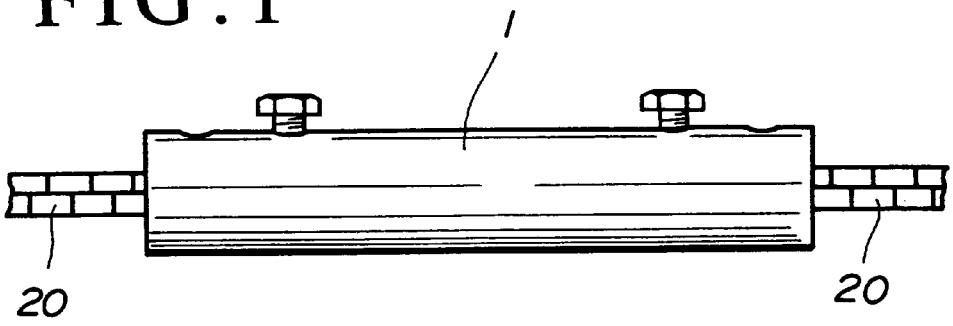
FIG. 1 is a longitudinal view of the mortar grout splice sleeve for reinforcing bars according to the invention.

An overall view of the mortar grout splice sleeve 1 of the invention is shown in FIG. 1, in which the sleeve 1 receives the opposite reinforcing bars 20.

Figure 2:
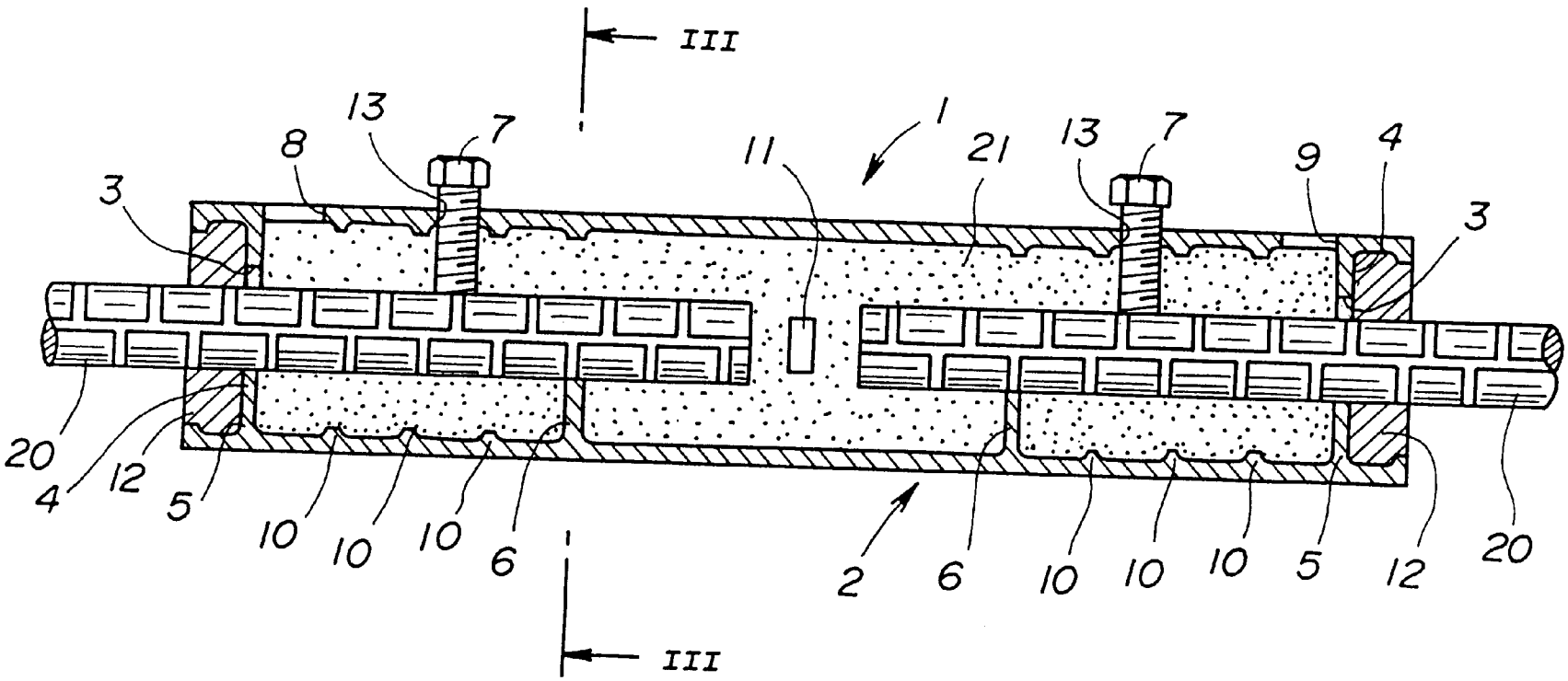
FIG. 2 is a longitudinal, sectional view illustrating the structure and association of the splice sleeve with the reinforcing bars and grouting.

As shown in FIG. 2, the mortar grout splice sleeve 1 includes a tubular metal shell 2. The shell 2 is of one piece construction, preferably cast steel. It has two openings 3 formed in both end walls 4 of the shell 2. The openings 3 are diametrally smaller than the inner diameter of the shell 2, but larger than the outer diameter of the reinforcing bars 20 to be inserted through the opening. The shell 2 is formed in the internal circumference thereof with two pairs of outward and inward supporting projections 5 and 6. The outward and inward supporting projections 5 and 6 form two supporting points axially separated to support one reinforcing bar 20 cooperatively. The outward supporting projections 5 are formed integrally with the opposite end walls 4. Mostly, the both reinforcing bars 20 have the same diameter, but they can have the different diameters thereof from each other. The supporting projections 5 and 6 are arranged to support the individual reinforcing bars 20 coaxial to the shell 2.

Figure 3:
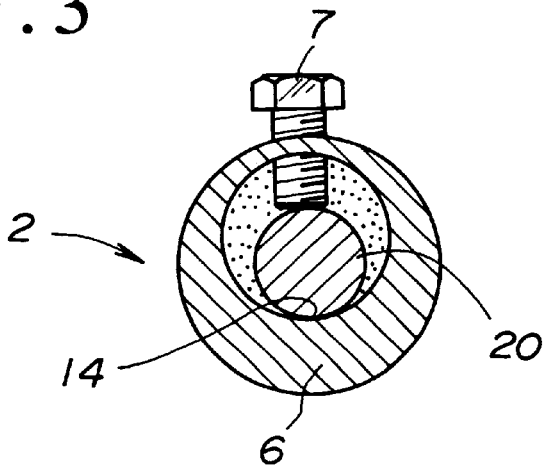
FIG. 3 is a cross-sectional view along line A—A of FIG. 2.

As shown in FIGS. 2 and 3, the outward and inward supporting projections 5 and 6 have a similar cross-section in the form of a hollow circle with a circular recess 14. The circular recess 14 is eccentric to receive the reinforcing bar 20 coaxial to the shell. The outward supporting projection 5 has its eccentric recess integral with the opening 3 of the shell 2. Two screwed holes 13 are formed at two positions axially between the respective outward and inward supporting positions 5 and 6 in the tubular portion of the shell 2. The hole 13 is angularly similar to the eccentric recess with respect to the axis of the shell 2. A bolt 7 as fixing means is screwed into the hole 13 from outside in a manner that the bolt end thrusts the reinforcing bar to the supporting projections 5 and 6.

The shell 2 is formed near one of the both end walls 4 in the external circumference with a grout port 8 through which mortar 21 is injected into the inside of shell 2. The shell 2 is also formed near the other end wall 4 in the external circumference thereof with an exhaust 9 through which air flows out of the shell 2 when the shell 2 is filled with mortar 21.

The shell 2 has a plurality of annular ridges 10 formed in the internal circumference thereof. The annular ridges 10 are smaller in radial height than the supporting projections 5 and 6. The annular ridges 10 as well as the supporting projections 5 and 6 increase the internal surface area of the shell 2 for bonding engagement with mortar. The shell 2 is formed at a longitudinal center in the internal circumference thereof with a separator 11 to prevent the excessive insertion of the reinforcing bar 20. Two annular seals 12 are fitted in the outward receiving portion of the end walls 4 to seal the inside of the shell 2. The reinforcing bars 20 penetrate the respective seals 12. Then, hereinafter described is a way to use the mortar grout splice sleeve 1.

Firstly, the seals 12 are slidably fitted on the respective reinforcing bars 20. The reinforcing bars 20 are inserted into the shell 2 through the respective openings 3. The both reinforcing bars 20 have their endwise positions defined by the separator 11. Thereafter, the bolts 7 are so screwed in the holes 13 as to press the individual reinforcing bars 20 to the respective supporting projections 5 and 6. Thus, the both reinforcing bars 20 are fixedly supported among the bolts 7 and supporting projections 5 and 6 in an axial alignment with the shell 2. Each seal 12 is mounted in the end wall 4. Thereafter, the shell 2 is supplied with the mortar 21 through the grout port 8 until the shell 2 has its internal void filled up with the mortar. An outflow of mortar from the exhaust 9 indicates that the shell 2 is filled up with the mortar. The splicing of the reinforcing bars 20 finishes when the mortar 21 hardens. The sleeve 1 holds the reinforcing bars 20 fixedly prior to mortar hardening, so that the reinforcing bars 20 are always free from being out of order.

Figure 8:
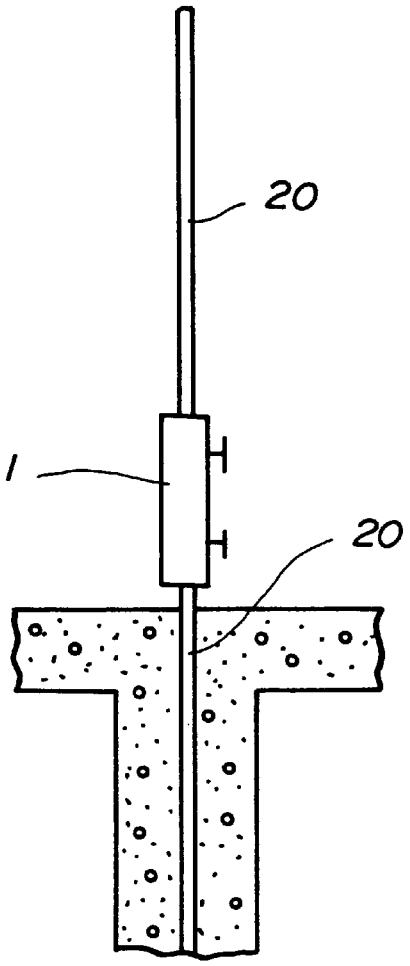
FIG. 8 is an elevational view illustrating the sleeve used in the cast-in-place concrete construction method.
Figure 9:
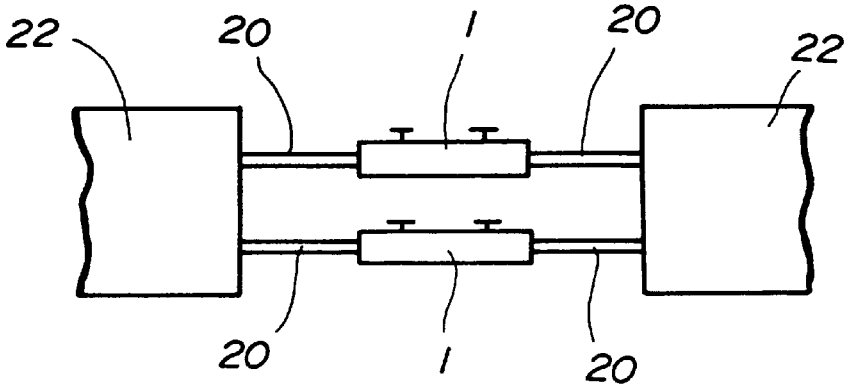
FIG. 9 is an elevational view illustrating the sleeve used in the precast concrete construction method.

By the use of the mortar grout splice sleeve 1, an easy and reliable end-to-end connection between the opposite reinforcing bars 20 is made in the cast-in-place concrete construction method as shown in FIG. 8. The sleeve 1 is also available for an easy and reliable end-to-end connection of the opposite reinforcing bars 20 projected from the both precast concrete members 22 in the precast concrete construction method as shown in FIG. 9.

Figure 5:
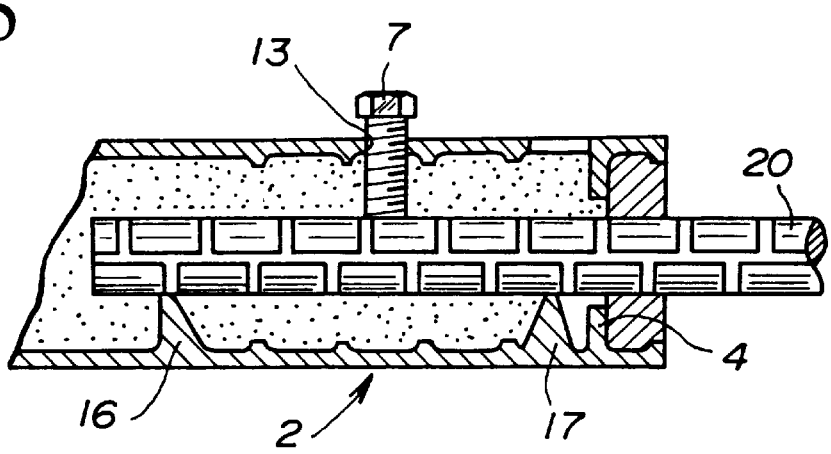
FIG. 5 is a longitudinal, sectional view of a part of another embodiment.
Figure 6:
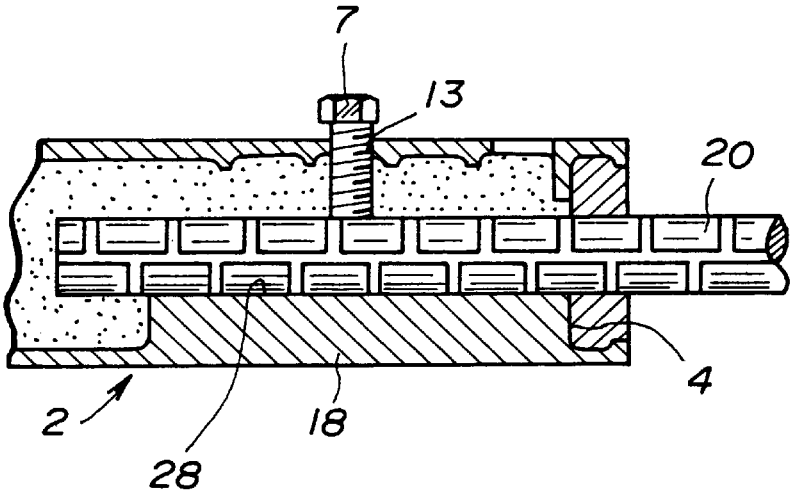
FIG. 6 is a longitudinal, sectional view of a part of another embodiment.
Figure 7:
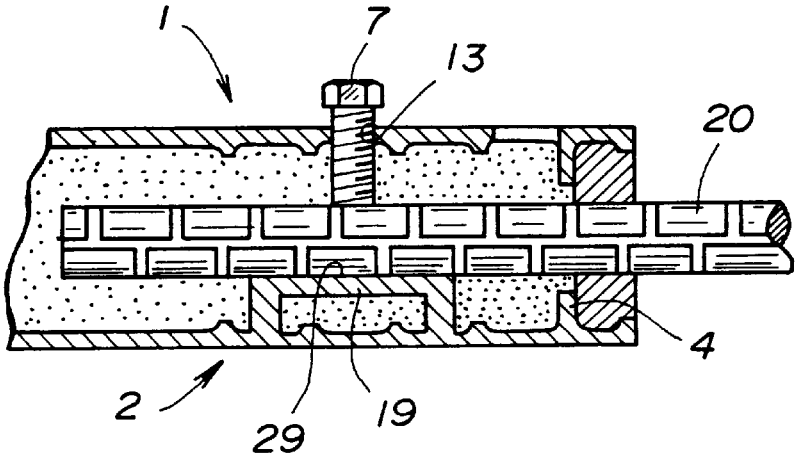
FIG. 7 is a longitudinal sectional view of another embodiment.

The outside supporting projection 17 is separable from the end wall 4 as shown in FIG. 5. The outward supporting projection 18 is integrally formed both with the inward supporting projection and with the end wall 4 to form an oblong supporting projection having an axially continuous supporting face 28 longer than a distance between both adjacent ridges of the reinforcing bar 20 as shown in FIG. 6. The outward supporting projection 19 is separated from the end wall 4 and joined with the inward supporting projection to form an axially continuous supporting face 29 as shown in FIG. 7.

Figure 4:
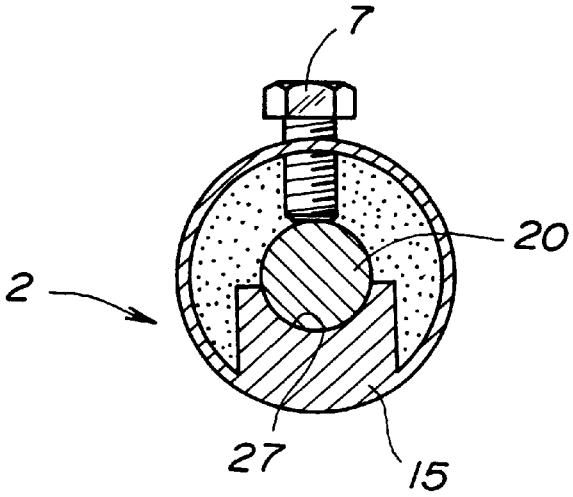
FIG. 4 is a cross-sectional view of another embodiment.
Figure 10:
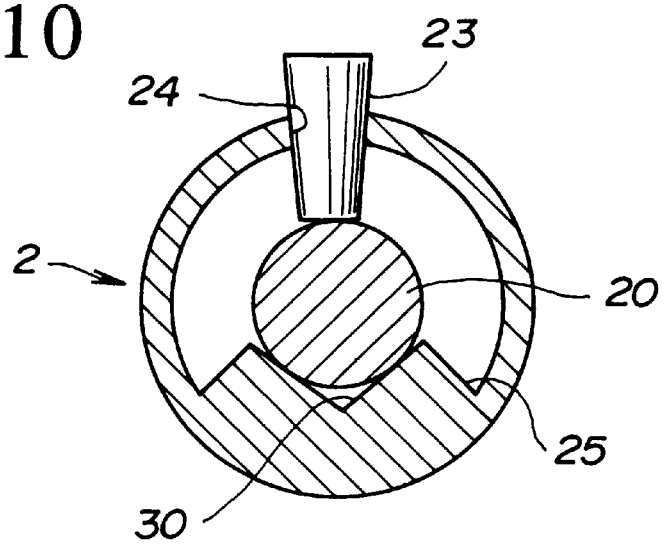
FIG. 10 is a cross-sectional view of a further embodiment.

The supporting projection can have any cross-section shape suitable to receive the reinforcing bar coaxial to the shell in cooperation with the fixing means. As shown in FIG. 4, the supporting projection 15 has a rectangular cross-section with a semicircular recess 27. The bolt 7 pushes the reinforcing bar 20 in the recess 27 to hold it coaxial to the shell 2. The supporting projection 25 has a sectoral cross-section with a V-shaped recess 30 as shown in FIG. 10. The supporting projection can have any longitudinal section shape suitable to support the reinforcing bar parallel to the shell in cooperation with the fixing means. The projections 16 and 17 have the respective right-angle and equilateral triangular longitudinal sections as shown FIG. 5. The bolt 7 is screwed in the hole 13 to hold the reinforcing bar 20 coaxial to the shell 2. As shown in FIGS. 6 and 7, the oblong projections 18 and 19 have the respective solid and hollow rectangular longitudinal sections. The bolts 7 are screwed in the holes 13 to hold the reinforcing bars 20 coaxial to the shell 2.

Figure 11:
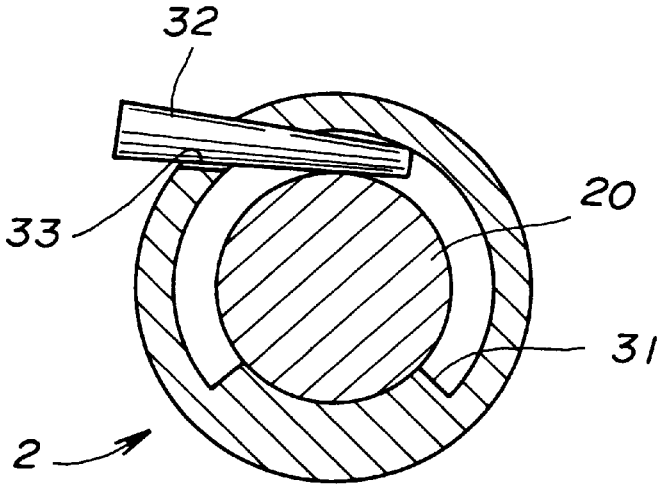
FIG. 11 is a cross-sectional view of still a further embodiment.
Figure 12:
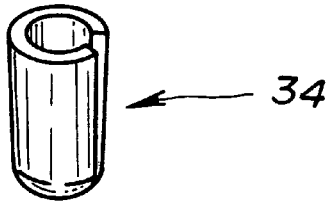
FIG. 12 is a perspective view of a coil-type spring pin for use as fixing means.

As the fixing means for use with the mortar grout splice sleeve 1, a pin is also utilizable to fasten the reinforcing bar 20 in place of the screw bolt as shown in FIGS. 10 and 11. The taper pin 23 is forced into the hole 24 of which the axis directs radial to the common axes of the reinforcing bar 20 and the shell 2. The pin 23 has its end thrusting the reinforcing bar 20 in the V-shaped recess 30 of the supporting projection 25. As shown in FIG. 11, the shell 2 is selectively formed in the tubular portion thereof with a hole 33 directing chordal to the circular cross-section of the shell 2. The taper pin 32 is forced into the hole 33 tangential to the reinforcing bar 20. The pin 32 has its side pushing the reinforcing bar 20 to the supporting projection 30. The aforementioned taper pin can be replaced by a coil-type spring pin 34 as shown in FIG. 12.

We claim:

1. A sleeve for splicing together reinforcing are disposed in an opposing, end-to-end relationship which comprises:

a tubular shell member provided with opposing end walls, a grout port provided in said tubular shell for adding grout to the interior of the tubular shell, apertures provided in said end walls for receiving the reinforcing bars from opposite ends thereof, a plurality of supporting projections integrally formed with the tubular shell and extending from one side of said tubular shell, said apertures in said end walls defining a portion of said supporting projections, fixing means inserted into said tubular shell on longitudinally opposite sides from said supporting projections and intermediate said supporting projections for fastening the reinforcing bar to said supporting projections, said supporting projections being formed, in cross section, with a recess for receiving the reinforcing bar coaxial to the tubular shell.

2. The sleeve of claim 1, wherein the remaining supporting projections are interior supporting projections disposed intermediate the end walls.

3. The sleeve of claim 1, wherein the supporting projections are axially separated from each other.

4. The sleeve claim 1, wherein a plurality of ridges extend from the internal side walls of the tubular shell.

5. The sleeve of claim 2, wherein the interior supporting projections have an axially continuous supporting face which extends longitudinally within the tubular shell.

6. The sleeve of claim 1, wherein the fixing means is a bolt screwed into the tubular shell substantially perpendicular to the reinforcing bars.

7. The sleeve of claim 1, wherein the fixing means is a pin forced by friction fit into the tubular shell substantially perpendicular to the reinforcing bar.

8. The sleeve of claim 1, wherein the fixing means is a pin forced by friction fit into the tubular shell substantially tangential to the reinforcing bar.

9. The sleeve of claim 1, wherein the supporting projections provide extended surface contact with said reinforcing bars.

10. A sleeve for splicing reinforcing bars disposed in an opposing, end-to-end relationship which comprises:

a tubular shell member provided with opposing end walls, said tubular shell having internal side walls which have a plurality of ridges extending therefrom, a group port provided in said tubular shell for adding grout to the interior of the tubular shell, apertures provided in said end walls for receiving the reinforcing bars from opposite ends thereof, a plurality of supporting projections integrally formed with the tubular shell and extending from one side of said tubular shell, fixing means inserted into said tubular shell on longitudinally opposite sides from said supporting projections and intermediate said supporting projections for fastening the reinforcing bar to said supporting projections, said supporting projections being formed, in cross section, with a recess for receiving the reinforcing bar coaxial to the tubular shell.

* * * * *